US008717135B2

(12) United States Patent
Wada et al.

(10) Patent No.: US 8,717,135 B2
(45) Date of Patent: May 6, 2014

(54) ELECTRONIC COMPONENT AND METHOD OF MANUFACTURING THE SAME

(75) Inventors: Koichiro Wada, Takasaki (JP); Masashi Kuwahara, Takasaki (JP); Yoshinari Nakada, Takasaki (JP); Yuichi Kasuya, Takasaki (JP); Masanori Takahashi, Takasaki (JP); Tetsuo Kumahora, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 12 days.

(21) Appl. No.: 13/566,836

(22) Filed: Aug. 3, 2012

(65) Prior Publication Data

US 2013/0200972 A1 Aug. 8, 2013

(30) Foreign Application Priority Data

Aug. 25, 2011 (JP) ..... 2011-183443

(51) Int. Cl.
*H01F 27/02* (2006.01)
*H01F 27/24* (2006.01)

(52) U.S. Cl.
USPC ..... 336/90; 336/83; 336/233; 336/234

(58) Field of Classification Search
USPC ..... 336/90, 83, 233, 234
See application file for complete search history.

(56) References Cited

U.S. PATENT DOCUMENTS 3,607,528 A * 9/1971 Gassaway ..... 156/230
5,522,946 A 6/1996 Tomita et al.
6,348,850 B1 * 2/2002 Kimura et al. ..... 336/200
7,209,022 B2 * 4/2007 Kuroiwa et al. ..... 336/83
7,477,122 B2 * 1/2009 Iguchi et al. ..... 336/192
7,507,470 B2 * 3/2009 Kim et al. ..... 428/323
7,656,260 B2 * 2/2010 Suzuki et al. ..... 336/192
7,786,838 B2 * 8/2010 Nakada et al. ..... 336/200
2002/0097124 A1 7/2002 Inoue et al.
2005/0167639 A1 * 8/2005 Hoshio et al. ..... 252/512
2007/0290161 A1 12/2007 Tokuoka et al.

(Continued)

FOREIGN PATENT DOCUMENTS

JP H04-361506 A 12/1992
JP 2000-030925 A 1/2000

(Continued)

OTHER PUBLICATIONS

Korean Office Action issued by the Korean Patent Office, mailed Jul. 24, 2013, for Korean counterpart application No. 10-2012-0033726.

(Continued)

*Primary Examiner* — Alexander Talpalatski
*Assistant Examiner* — Kazi Hossain
(74) *Attorney, Agent, or Firm* — Law Office of Katsuhiro Arai

(57) ABSTRACT

An electronic component has a drum-shaped core member constituted by an assembly of soft magnetic alloy grains containing iron (Fe), silicate (Si) and chromium (Cr), a coil conductive wire wound around the core member, a pair of terminal electrodes connected to ends of the coil conductive wire, and an outer sheath resin part covering the wound coil conductive wire and constituted by a magnetic powder-containing resin; wherein there is an area where only the resin material in the magnetic powder-containing resin is permeated from the surface of the core member to a specified depth.

6 Claims, 7 Drawing Sheets

(56) References Cited

U.S. PATENT DOCUMENTS

| | | | | |
|---|---|---|---|---|
| 2008/0061264 | A1 | 3/2008 | Maeda et al. | |
| 2008/0152897 | A1 | 6/2008 | Maeda et al. | |
| 2008/0231409 | A1 | 9/2008 | Kugai et al. | |
| 2009/0067117 | A1 * | 3/2009 | Kasuya et al. | 361/321.2 |
| 2010/0201473 | A1 * | 8/2010 | Konoue et al. | 336/200 |
| 2010/0289609 | A1 | 11/2010 | Liao et al. | |
| 2011/0024670 | A1 | 2/2011 | Otsuki et al. | |
| 2012/0146759 | A1 | 6/2012 | Shibuya et al. | |

FOREIGN PATENT DOCUMENTS

| | | | |
|---|---|---|---|
| JP | 2001-185421 | A | 7/2001 |
| JP | 2002-305108 | A | 10/2002 |
| JP | 2007-299871 | A | 11/2007 |
| JP | 2009-021310 | A | 1/2009 |
| JP | 2009-088496 | A | 4/2009 |
| JP | 2009-088502 | A | 4/2009 |
| JP | 2009-158735 | A | 7/2009 |
| JP | 2010-016217 | A | 1/2010 |
| WO | 2011/027559 | A1 | 3/2011 |

OTHER PUBLICATIONS

Notification of Reasons for Refusal issued by the Japanese Patent Office, mailed Jul. 10, 2013, for Japanese counterpart application No. 2011-183443.

* cited by examiner (a)

(b)

(a)

(b)

| | Water absorption coefficient (%) | Apparent density ($g/cm^3$) | True density ($g/cm^3$) | Void ratio (%) |
|---|---|---|---|---|
| Assembly of soft magnetic alloy particles | 2 | 6.2 | 7.6 | 18.4 |
| Ferrite | 0.2 | 5.34 | 5.35 | 0.2 |

(a)

(b)

(a)

(b)

(a)

(b)

ELECTRONIC COMPONENT AND METHOD OF MANUFACTURING THE SAME

BACKGROUND

1. Field of the Invention

The present invention relates to an electronic component and a method of manufacturing such electronic component, and more specifically to an electronic component having an outer sheath structure that protects components and circuits installed on a substrate and providing electrical functions, as well as a method of manufacturing such electronic component.

2. Description of the Related Art

Electronic components having a resin outer sheath (or resin sealing) structure that protects, by means of covering with a resin material, components and circuits installed on a substrate or board and providing electrical functions, have traditionally been known. Incidentally, electronic components installed in mobile phones and other portable electronic devices face a strong demand for high durability against changes in the use environment (temperature, humidity, etc.) from the viewpoint of reliability.

Examples of such electronic components include the surface-mounted wire wound inductor described in Patent Literature 1, which comprises a drum-shaped ferrite core and a conductive wire winding around the ferrite core, with the conductive wire covered and protected with an outer sheath resin material. Here, Patent Literature 1 discloses that, by adjusting the composition of the outer sheath resin material, the linear expansion coefficient of the ferrite core can be brought closer to that of the outer sheath resin and therefore the durability of the inductor against changes in temperature can be enhanced. Such an inductor applying a ferrite core is suitable for high-density mounting and low-height mounting on a circuit board because it is generally possible to reduce the outer dimensions (especially height dimension) of such an inductor.

PATENT LITERATURE

[Patent Literature 1] Japanese Patent Laid-open No. 2010-016217

SUMMARY

As electronic devices become increasingly smaller, thinner, and higher in function in recent years, the market is seeking electronic components (such as inductors) offering desired electrical characteristics (such as inductor characteristics) and high reliability, while allowing for high-density mounting and low-height mounting at the same time. On the other hand, the market is seeking methods for manufacturing electronic components without lowering reliability while further improving productivity in order to accommodate falling prices of electronic devices.

The first object of the present invention is to provide a small electronic component offering improved electrical characteristics and reliability, while allowing for good high-density mounting and low-height mounting on a circuit board at the same time, as well as a method of manufacturing such electronic component.

The second object of the present invention is to provide a small electronic component offering desired electrical characteristics and reliability, while improving productivity at the same time, as well as a method of manufacturing such electronic component.

An electronic component conforming to the invention under Embodiment 1 is characterized by comprising:

a base material constituted by an assembly of soft magnetic alloy grains;

a sheathed conductive wire wound around the base material; and an outer sheath resin part constituted by a resin material containing a filler and which covers the outer periphery of the sheathed conductive wire;

wherein the resin material is permeated into the base material from the interface of the base material in contact with the outer sheath resin part.

The invention under Embodiment 2 is an electronic component according to Embodiment 1, characterized in that the resin material is permeated into the base material from the interface to a depth of 10 to 30 μm.

The invention under Embodiment 3 is an electronic component according to Embodiment 1 or 2, characterized in that the resin material constituting the outer sheath resin part contains the filler by 50 percent by volume or more.

The invention under Embodiment 4 is an electronic component according to any one of Embodiments 1 to 3, characterized in that the base material has a water absorption coefficient of 1.0% or more and a void ratio of 10 to 25%.

The invention under Embodiment 5 is an electronic component according to any one of Embodiments 1 to 4, characterized in that the base material is constituted by the soft magnetic alloy grains containing iron, silicate and another element that oxidizes more easily than iron, each soft magnetic alloy grain has an oxidized layer formed on its surface as a result of oxidization of the soft magnetic alloy grain, the oxidized layer contains the element that oxidizes more easily than iron by an amount greater than does the soft magnetic alloy grain, and the grains are bonded together via their oxidized layers.

The invention under Embodiment 6 is an electronic component according to Embodiment 5, characterized in that the element that oxidizes more easily than iron is chromium and the soft magnetic alloy contains chromium by at least 2 to 15 percent by weight.

The invention under Embodiment 7 is an electronic component according to any one of Embodiments 1 to 6, characterized by comprising:

the base material having a pillar-shaped core and a pair of flange parts provided on both sides of the core;

the sheathed conductive wire wound around the core of the base material;

a pair of terminal electrodes provided on the outer surfaces of the flange parts and connected to both ends of the sheathed conductive wire; and the outer sheath resin part provided between the pair of flange parts in a manner covering an outer periphery of the sheathed conductive wire;

wherein the resin material is permeated at least through the surfaces contacted by the outer sheath resin part and facing the pair of flange parts.

A method of manufacturing an electronic component conforming to the invention under Embodiment 8 is characterized by comprising:

a step to wind a sheathed conductive wire around a base material constituted by an assembly of soft magnetic alloy grains;

a step to apply a resin material containing a filler by a first content ratio onto a surface of the base material in a manner covering an outer periphery of the sheathed conductive wire;

a step to permeate the resin material from the interface contacted by the outer sheath resin part into the base material to a specified depth; and a step to dry and cure the resin material to form an outer sheath resin part constituted by the resin material whose filler content has been changed to a second content ratio which is higher than the first content ratio.

The invention under Embodiment 9 is a method of manufacturing an electronic component according to Embodiment 8, characterized in that, in the step to permeate the resin material into the base material, the resin material is permeated from the interface into the base material to a depth of 10 to 30 μm.

The invention under Embodiment 10 is a method of manufacturing an electronic component according to Embodiment 8 or 9, characterized in that, in the step of applying the resin material, the first content ratio of the filler in the resin material is 40 percent by volume or more.

The invention under Embodiment 11 is a method of manufacturing an electronic component according to any one of Embodiments 8 to 10, characterized in that the base material has a water absorption coefficient of 1.0% or more and a void ratio of 10 to 25%.

The invention under Embodiment 12 is a method of manufacturing an electronic component according to any one of Embodiments 8 to 11, characterized in that the base material is constituted by soft magnetic alloy grains containing iron, silicate and another element that oxidizes more easily than iron, each soft magnetic alloy grain has an oxidized layer formed on its surface as a result of oxidization of the soft magnetic alloy grain, the oxidized layer contains the element that oxidizes more easily than iron by an amount greater than does the soft magnetic alloy grain, and the grains are bonded together via their oxidized layers.

The invention under Embodiment 13 is a method of manufacturing an electronic component according to Embodiment 12, characterized in that the element that oxidizes more easily than iron is chromium and the soft magnetic alloy contains chromium by at least 2 to 15 percent by weight.

The present invention provides a small electronic component offering improved electrical characteristics and reliability, while allowing for good high-density mounting and low-height mounting on a circuit board at the same time, as well as a method of manufacturing such electronic component, and contributes to size/thickness reduction, functional enhancement, and reliability improvement of electronic devices in which such electronic component is installed.

The present invention also provides a small electronic component offering desired electrical characteristics and reliability, while improving productivity at the same time, as well as a method of manufacturing such electronic component, and contributes to cost reduction of electronic components demonstrating specified reliability.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

10 Wire wound inductor
11 Core member
11*a* Core
11*b* Upper flange part
11*c* Lower flange part
11*d* Area where the resin material is permeated
12 Coil conductive wire
16A, 16B Terminal electrode
18 Outer sheath resin part
S101 Core member manufacturing step
S102 Terminal electrode forming step
S103 Coil conductive wire winding step
S104 Outer sheath step
S105 Coil conductive wire bonding step

DETAILED DESCRIPTION

Electronic components and methods of manufacturing such electronic components conforming to the present invention are explained below in detail by presenting an embodiment. The following explanations assume that a wire wound inductor is applied as an electronic component conforming to the present invention. It should be noted that the embodiment presented herein is only one example that can be applied as an electronic component conforming to the present invention and the present invention is not at all limited to this embodiment.

First, a rough constitution of a wire wound inductor applied as an electronic component conforming to the present invention is explained.

(Wire Wound Inductor)

Figure 1:
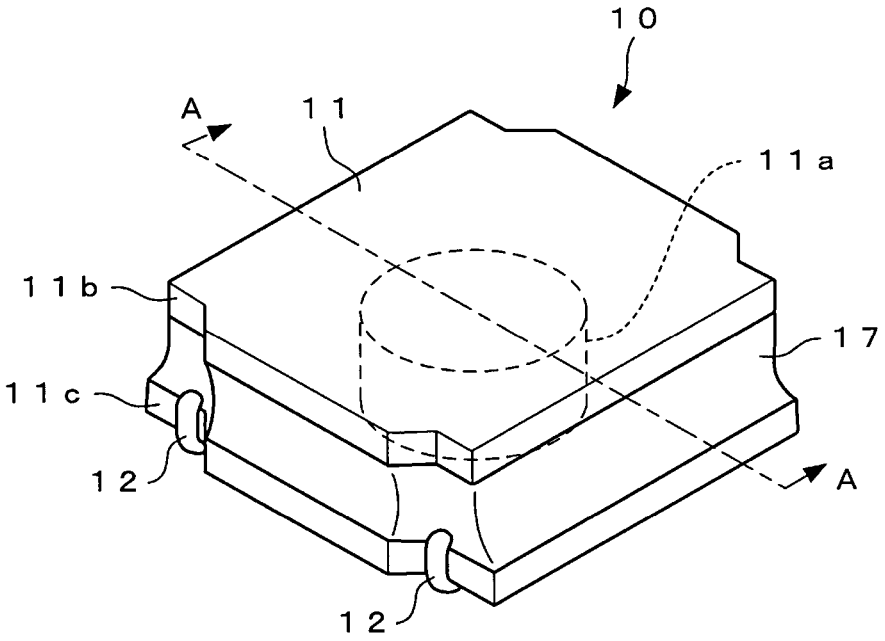
FIG. 1 illustrates schematic perspective views (showing a top in (a) and a bottom in (b)) of an embodiment of a wire wound inductor applied as an electronic component conforming to the present invention.
Figure 1:
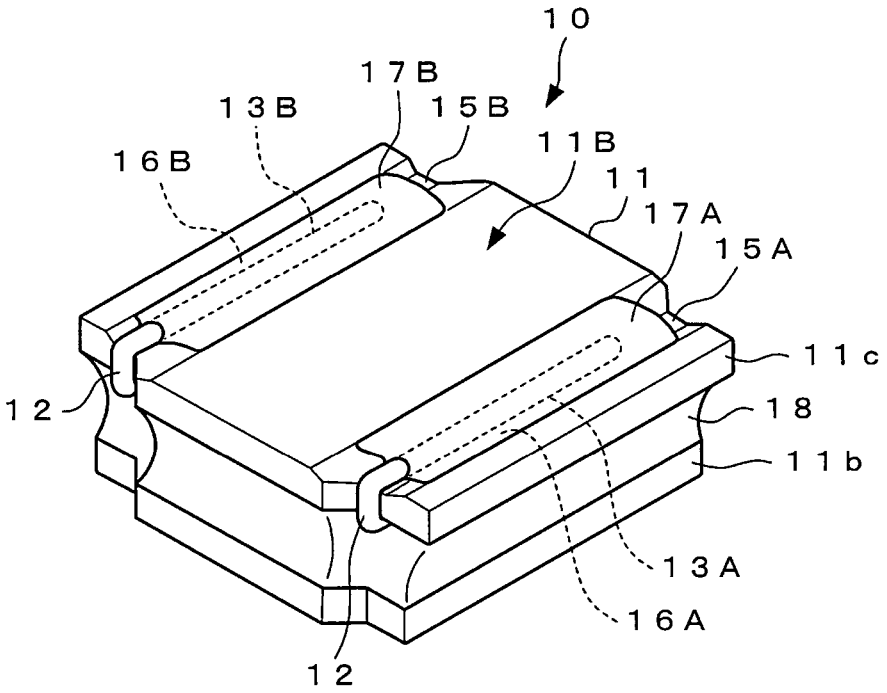
Figure 2:
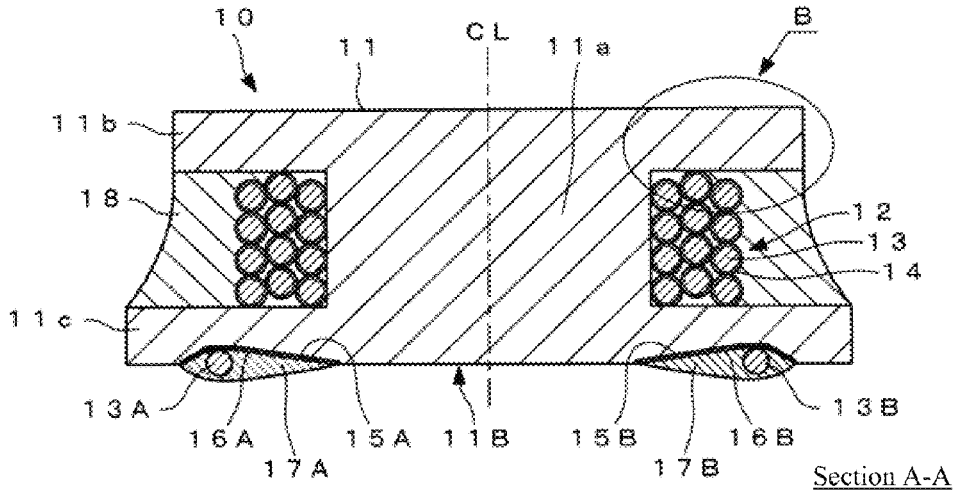
FIG. 2 illustrates schematic section views (showing in (a) a cross section taken along line A-A in FIG. 1 and showing in (b) an enlarged view of an area circled with B in (a)) showing the internal structure of a wire wound inductor conforming to this embodiment.
Figure 2:
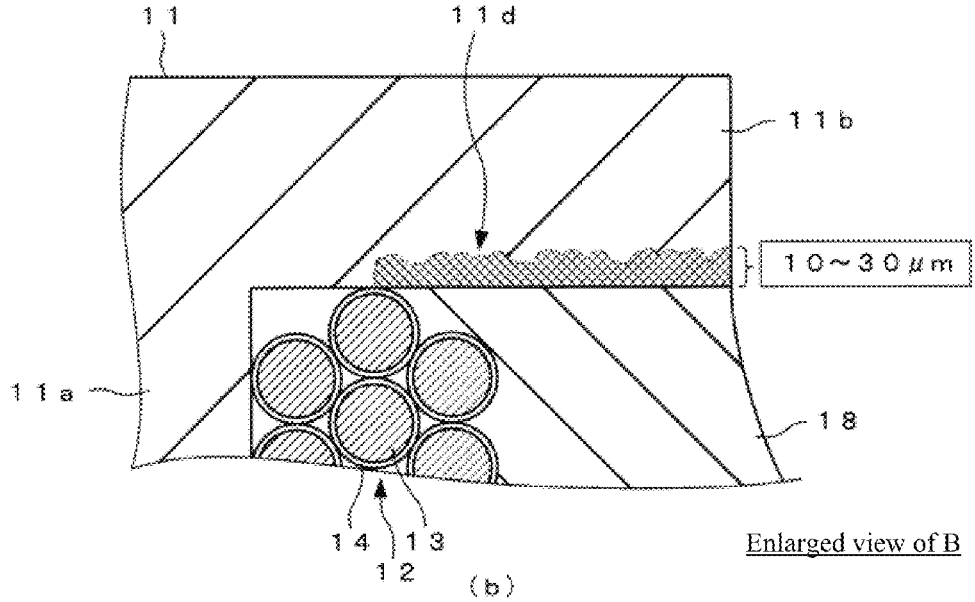

FIG. 1 illustrates schematic perspective views of an embodiment of a wire wound inductor applied as an electronic component conforming to the present invention. Here, (a) in FIG. 1 is a schematic perspective view of a wire wound inductor conforming to this embodiment as viewed from its top face (upper flange part), while (b) in FIG. 1 is a schematic perspective view of a wire wound inductor conforming to this embodiment as viewed from its bottom face (lower flange part). FIG. 2 illustrates schematic section views showing the internal structure of a wire wound inductor conforming to this embodiment. Here, (a) in FIG. 2 is a section view of the wire wound inductor shown in (a) in FIG. 1 cut along line A-A, while (b) in FIG. 2 is a section view of a key part providing an enlarged view of B shown in FIG. 2(*a*).

As shown in FIGS. 1 and 2, the wire wound inductor conforming to this embodiment has a core member 11 having roughly a drum shape, a coil conductive wire 12 wound around the core member 11, a pair of terminal electrodes 16A, 16B connected to ends 13A, 13B of the coil conductive wire 12, and an outer sheath resin part 18 covering an outer periphery of the wound coil conductive wire 12 and constituted by a magnetic powder-containing resin.

To be specific, as shown in (a) in each of FIGS. 1 and 2, the core member 11 has a pillar-shaped core 11*a* around which the coil conductive wire 12 is wound, an upper flange part 11*b* provided at the upper end of the core 11*a* as shown in the drawing, and a lower flange part 11*c* provided at the lower end of the core 11*a* as shown in the drawing, and its exterior has a drum shape.

Here, as shown in FIG. 1 and (a) in FIG. 2, preferably the core 11*a* of the core member 11 has a roughly circular or circular section so that the length of the coil conductive wire 12 needed to achieve a specified number of windings can be minimized, but the section shape is not at all limited to the foregoing. Preferably the outer shape of the lower flange part 11*c* of the core member 11 has a roughly square or square shape in plan view so as to achieve size reduction to support high-density mounting, but the outer shape is not at all limited to the foregoing, and a polygon, rough circle or other shape is also acceptable. Also, the outer shape of the upper flange part 11*b* of the core member 11 preferably has a shape corresponding and similar to the lower flange part 11*c*, and preferably has a size equal to or slightly smaller than the lower flange part 11*c*, so as to achieve size reduction to support high-density mounting.

By providing the upper flange part 11*b* and lower flange part 11*c* at the upper end and lower end of the core 11*a* this way, the winding position of the coil conductive wire 12 relative to the core 11*a* can be controlled with greater ease and inductor characteristics can be stabilized. In addition, by chamfering, or the like, the four corners of the upper flange part 11*b* as deemed appropriate, the magnetic powder-containing resin that constitutes the outer sheath resin part 18 mentioned later can easily be filled between the upper flange part 11*b* and lower flange part 11*c*. The lower thickness limits of the upper flange part 11*b* and lower flange part 11*c* are set as deemed appropriate so that a specified strength can be satisfied, by considering the overhang dimensions of the upper flange part 11*b* and lower flange part 11*c*, respectively, from the core 11*a* of the core member 11.

Additionally, as shown in FIGS. 1(*b*) and 2(*a*), a pair of terminal electrodes 16A, 16B are provided on the bottom surface (outer surface) 11B of the lower flange part 11*c* of the core member 11 in a manner sandwiching a line extended from the center axis CL of the core 11*a*. Here, grooves 15A, 15B may be formed in the bottom surface 11B, as shown in FIGS. 1(*b*) and 2(*a*), for example, in the areas where the pair of terminal electrodes 16A, 16B are formed (electrode forming areas).

Here, for the wire wound inductor 10 conforming to this embodiment, a porous compact is applied whose core member 11 has a water absorption coefficient of 1.0% or more and a void ratio of 10 to 25%. To be specific, for the wire wound inductor conforming to this embodiment, a porous compact can be applied whose core member 11 is constituted by soft magnetic alloy grains containing iron (Fe), silicate (Si) and another element that oxidizes more easily than iron, for example, where each soft magnetic alloy grain has an oxidized layer formed on its surface as a result of oxidization of the soft magnetic alloy grain, the oxidized layer contains the element that oxidizes more easily than iron by an amount greater than does the soft magnetic alloy grain, and the grains are bonded together via their oxidized layers. Particularly under this embodiment, chromium (Cr) can be applied as the element that oxidizes more easily than iron, preferably the soft magnetic alloy grain contains chromium by 2 to 15 percent by weight, and preferably the average grain size of the soft magnetic alloy grain is approx. 2 to 30 μm in general.

As described above, by setting the chromium content in the soft magnetic alloy grain constituting the core member 11 and the average grain size of the soft magnetic alloy grain within the aforementioned ranges as deemed appropriate, a high saturated magnetic flux density Bs (1.2 T or more) and high magnetic permeation ratio μ (37 or more) can be achieved, while eddy current loss in the grain can be suppressed even at frequencies of 100 kHz or above. Then, by the fact that it has such high magnetic permeation ratio μ and high saturated magnetic flux density Bs, the wire wound inductor 10 conforming to this embodiment achieves excellent inductor characteristics (inductance vs. direct-current bias characteristics: L vs. Idc characteristics).

Additionally for the coil conductive wire 12, a sheathed conductive wire constituted by a metal wire 13 made of copper (Cu), silver (Ag), etc., and an insulation sheath 14 made of polyurethane resin, polyester resin, etc., and formed on the outer periphery of the metal wire can be applied. Then, the coil conductive wire 12 is wound around the pillar-shaped core 11*a* of the core member 11 and, as shown in FIG. 1 and (a) in FIG. 2, its one end 13A and other end 13B are conductively connected to the terminal electrodes 16A, 16B via solders 17A, 17B, respectively, with the insulation sheath 14 removed.

Here, the coil conductive wire 12 is, for example, a sheathed conductive wire of 0.1 to 0.2 mm in diameter, which is wound around the core 11*a* of the core member 11 by 3.5 to 15.5 times. The metal wire 13 applied for the coil conductive wire 12 is not limited to a single wire, and it may comprise two or more wires or twisted wires. Also, the metal wire 13 of the coil conductive wire 12 is not limited to one having a circular section shape, and a rectangular wire having a rectangular section shape or square wire having a square section shape may be used, for example. In addition, if the terminal electrodes 16A, 16B are provided in the grooves 15A, 15B, preferably the diameters of the ends 13A, 13B of the coil conductive wire 12 are set larger than the depths of the grooves 15A, 15B.

The aforementioned conductive connection via solder between the ends 13A, 13B of the coil conductive wire 12 and terminal electrodes 16A, 16B means that there should be at least a location where the two sides are conductively connected via solder, and conductive connection via solder is not the exclusive method. For example, a structure is also allowed wherein there are locations where the terminal electrodes 16A, 16B and ends 13A, 13B of the coil conductive wire 12 are joined together via metal bonds by means of thermal compression, with the joined locations covered by solder.

If the terminal electrodes 16A, 16B are provided in the grooves 15A, 15B, as shown in (b) in FIG. 1 and (a) in FIG. 2, for example, they are connected to the ends 13A, 13B of the coil conductive wire 12 extending along the grooves 15A, 15B. Also, various electrode materials can be used for the terminal electrodes 16A, 16B, and silver (Ag), alloy of silver (Ag) and palladium (Pd), alloy of silver (Ag) and platinum (Pt), copper (Cu), alloy of titanium (Ti), nickel (Ni) and tin (Sn), alloy of titanium (Ti) and copper (Cu), alloy of chromium (Cr), nickel (Ni) and tin (Sn), alloy of titanium (Ti), nickel (Ni) and copper (Cu), alloy of titanium (Ti), nickel (Ni) and silver (Ag), alloy of nickel (Ni) and tin (Sn), alloy of nickel (Ni) and copper (Cu), alloy of nickel (Ni) and silver (Ag), and phosphor bronze, etc., can be applied favorably, for example. For the terminal electrodes 16A, 16B using these electrode materials, a baked electrode obtained by applying an electrode paste constituted by silver (Ag), alloy containing silver (Ag) or the like with added glass to the inside of the grooves 15A, 15B or bottom surface 11B of the lower flange part 11*c* and then baking the paste at a specified temperature can be applied favorably, for example. As another form of terminal electrodes 16A, 16B, an electrode frame obtained by bonding a sheet-shaped member (frame) made of phosphor bronze, etc., to the bottom surface 11B of the lower flange part 11*c* using an epoxy resin or other adhesive can be applied favorably, for example. As yet another form of terminal electrodes 16A, 16B, an electrode film obtained by using titanium (Ti), alloy containing titanium (Ti) or the like to form a thin metal film on the inside of the grooves 15A, 15B or bottom surface 11B of the lower flange part 11*c* by means of the sputtering method, deposition method, etc., can be applied favorably, for example. If the aforementioned baked electrode or electrode film is applied for the terminal electrodes 16A, 16B, a metal plating layer of nickel (Ni), tin (Sn), etc., can be formed on its surface by means of electroplating.

The outer sheath resin part 18 is provided in such a way that the magnetic powder-containing resin covers the outer periphery of the coil conductive wire 12 wound around the core 11*a* between the upper flange part 11*b* and lower flange part 11*c* of the core member 11 that are facing each other and is filled in the area surrounded by the core 11*a*, upper flange part 11*b* and lower flange part 11*c*, as shown in (a) in FIG. 2.

For the magnetic powder-containing resin, a resin material having a specified visco-elasticity in the service temperature range of the wire wound inductor 10 and containing, by a specified ratio, an inorganic filler constituted by magnetic powder, silica ($SiO_2$) or other inorganic material can be applied. To be more specific, a magnetic powder-containing resin whose glass transition temperature is 100 to 150° C. in the process of changing from a glass state to a rubber state as the rigidity ratio property changes with temperature during curing, can be favorably applied.

Here, silicon resin can be favorably applied for the resin material, for example, and to shorten the lead time of the step where the magnetic powder-containing resin is charged between the upper flange part 11*b* and lower flange part 11*c* of the core member 11, a mixed resin containing epoxy resin and carboxyl base-modified propylene glycol can be applied.

Additionally for the inorganic filler contained in the magnetic powder-containing resin, various magnetic powders constituted by Fe—Cr—Si alloy, Mn—Zn ferrite or Ni—Zn ferrite, etc., or silica ($SiO_2$), etc., for the purpose of adjusting the visco-elasticity, may be used; however, it is preferable to use a magnetic powder having a specified magnetic permeation ratio, such as a magnetic powder having the same composition as the soft magnetic alloy grain constituting the core member 11 or substance containing such magnetic powder. In this case, preferably the average grain size of this magnetic powder is approx. 2 to 30 μm in general. In addition, preferably the magnetic powder-containing resin contains an inorganic filler constituted by magnetic powder by 50 percent by volume or more in general.

Then, the wire wound inductor 10 conforming to the present invention is characterized in that, as shown in (a) and (b) in FIG. 2, there is an area 11*d* where only the resin material in the magnetic powder-containing resin is permeated into the core member 11 to a specified depth from the interface where the outer sheath resin part 18 contacts the core member 11 (i.e., surface of the core member 11), in the region where the magnetic powder-containing resin constituting the outer sheath resin part 18 contacts the upper flange part 11*b* and lower flange part 11*c* of the porous core member 11. Here, preferably the depth to which the resin material permeates into the core member 11 is 10 to 30 μm in general.

This area where only the resin material in the magnetic powder-containing resin constituting the outer sheath resin part 18 permeates into the core member 11 allows at least the ratio (content) of the inorganic filler in the magnetic powder-containing resin to rise relatively near the interface where the outer sheath resin part 18 contacts the core member 11, thereby reducing the linear expansion coefficient of the magnetic powder-containing resin to make its difference from the linear expansion coefficient of the core member 11 smaller, consequently improving the resistance of the wire wound inductor 10 against changes in the use environment (especially temperature change). Or, such area helps maintain the resistance of the wire wound inductor 10 against changes in the use environment (especially temperature change) and at the same time allows the ratio (content) of the inorganic filler in the magnetic powder-containing resin constituting the outer sheath resin part 18 to be set lower, which has the effect of improving the discharge property and fluidity of the magnetic powder-containing resin in the application step to fill the magnetic powder-containing resin between the upper flange part 11*b* and lower flange part 11*c*, thereby improving the productivity of the wire wound inductor 10.

(Method of Manufacturing Wire Wound Inductor)

Next, a method of manufacturing the above wire wound inductor is explained.

Figure 3:
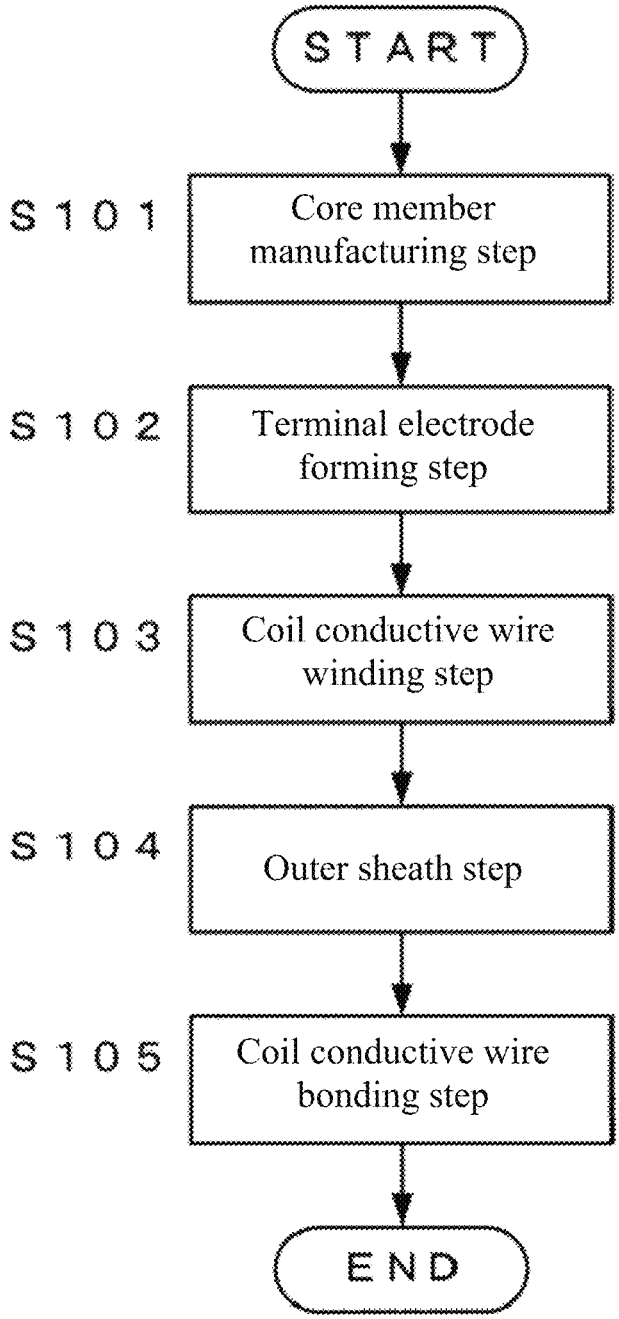
FIG. 3 illustrates a flow chart showing a method of manufacturing a wire wound inductor conforming to this embodiment.

FIG. 3 is a flow chart showing a method of manufacturing a wire wound inductor conforming to the present invention.

As shown in FIG. 3, this wire wound inductor is roughly manufactured through a core member manufacturing step S101, terminal electrode forming step S102, coil conductive wire winding step S103, outer sheath step S104, and coil conductive wire bonding step S105.

(a) Core Member Manufacturing Step S101

In the core member manufacturing step S101, first material grains being soft magnetic alloy grains containing iron (Fe), silicate (Si) and chromium (Cr) at a specified ratio are mixed with a specified binder to form a compact of a specified shape. To be specific, a thermoplastic resin or other binder is added to material grains containing chromium by 2 to 15 percent by weight, silicate by 0.5 to 7 percent by weight and iron for the remainder, for example, and the grains and binder are agitated and mixed to obtain granules. Next, these granules are compression-formed using a powder forming press to form a compact and then centerlessly ground using a grinding disk, for example, to form a concaved section to shape a pillar shaped core 11*a* between the upper flange part 11*b* and lower flange part 11*c* to obtain a drum-shaped compact.

Next, the obtained compact is sintered. To be specific, the compact is heat-treated in atmosphere at 400 to 900° C. By heat-treating the compact in atmosphere this way, the mixed thermoplastic resin is removed (binder removal process), while chromium that was originally present in the grain and has moved to the surface due to heat treatment is bonded with the main constituent of the grain, namely iron, and oxygen, to produce an oxidized layer of metal oxide on the grain surface, and at the same time the oxidized layers on the surfaces of adjacent grains are bonded together. The produced oxidized layer (metal oxide layer) is an oxide constituted primarily by iron and chromium and provides the core member 11 constituted by an assembly of soft magnetic alloy grains while ensuring insulation between the grains.

Here, examples of the material grain include applying grains manufactured by the water atomization method, while examples of material grain shape include spherical and flat. Additionally, raising the heat treatment temperature in an oxygen atmosphere during the heat treatment breaks down the binder and oxidizes the soft magnetic alloy grains. Accordingly, the heat treatment conditions for the compact are preferably such that a temperature of 400 to 900° C. is held for at least 1 minute in atmosphere. By implementing heat treatment in this temperature range, an excellent oxidized layer can be formed. A more preferable temperature range is 600 to 800° C. Heat treatment may be implemented under conditions other than atmosphere, such as in atmosphere where the partial pressure of oxygen is equivalent to that in atmosphere. In a reducing atmosphere or non-oxidizing atmosphere, an oxidized layer of metal oxide is not produced by heat treatment and therefore grains are sintered together and the volume resistivity drops significantly. Also, the ambient oxygen concentration and vapor volume are not specifically limited, but atmosphere or dry air is preferred from the viewpoint of production.

By setting the heat treatment temperature to over 400° C., excellent strength and excellent volume resistivity can be obtained. If the heat treatment temperature exceeds 900° C., on the other hand, the strength will increase but the volume resistivity will drop. In addition, an oxidized layer of metal oxide containing iron and chromium is easily produced when the holding time at the above heat treatment temperature is set to 1 minute or longer. Although the upper limit of holding time is not set because the oxidized layer thickness saturates at a fixed value, it is appropriate to keep the holding time to 2 hours or less in consideration of productivity.

As explained above, the formation of an oxidized layer can be controlled by the heat treatment temperature, heat treatment time, oxygen volume in the heat treatment atmosphere, etc., and therefore by setting the heat treatment conditions in the above ranges, excellent strength and excellent volume resistivity can be achieved at the same time and a core member 11 constituted by an assembly of soft magnetic alloy grains having oxidized layers can be manufactured.

The method of obtaining the aforementioned drum-shaped compact is not limited to forming a concaved shape via centerless grinding on a peripheral side face of a compact formed by granules containing material grains, and a drum-shaped compact can be obtained by, for example, dry integral forming of granules using a powder forming press. In addition, the method of manufacturing the core member 11 is not limited to the aforementioned method of sintering a prepared drum-shaped compact, and it is also possible, for example, to prepare a compact formed by granules (compact not having a concaved section on its peripheral side face) and then perform a binder removal process and sintering at a specified temperature, after which a diamond wheel, etc., is used to cut a concaved section on a peripheral side face of the sintered compact.

Additionally when grooves 15A, 15B are formed in the bottom surface 11B of the core member 11, various methods can be used in the manufacturing process of the core member 11, such as providing a pair of elongated projections on the surface of an embossing die beforehand to form a pair of grooves at the same time a compact is formed by granules containing material grains, or cutting a surface of the obtained compact to form a pair of grooves, for example.

(b) Terminal Electrode Forming Step S102

Next, in the terminal electrode forming step S102, terminal electrodes 16A, 16B are formed in the grooves 15A, 15B or on the bottom surface 11B of the lower flange part 11*c* of the core member 11. Here, methods of forming terminal electrodes 16A, 16B include, as mentioned above, a method to apply and bake an electrode paste at a specified temperature, a method to bond an electrode frame using adhesive, and a method to form a thin film using the sputtering method, deposition method, and various other methods can be applied, as well. Here, an example of applying and baking an electrode paste is described as the most inexpensive but productive manufacturing method.

In the terminal electrode forming step, first an electrode paste containing an electrode material (such as silver, copper, etc., or multiple types of metal materials including the foregoing) in powder form and glass frit is applied to the inside of the grooves 15A, 15B or bottom surface 11B of the lower flange part 11*c*, and then the core member 11 is heat-treated to form terminal electrodes 16A, 16B.

Here, the electrode paste can be applied by applying, for example, the roller transfer method, pad transfer method or other transfer method, screen printing method, stencil printing method or other printing method, spray method, inkjet method, or the like. To properly accommodate the terminal electrodes 16A, 16B in the grooves 15A, 15B and achieve a stable width dimension, use of a transfer method is more preferred.

Furthermore, the contents of electrode material and glass in the electrode paste are set as deemed appropriate according to the type, composition, etc., of the electrode material used. Glass in the electrode paste has a composition containing glass and metal oxide of silicate (Si), zinc (Zn), aluminum (Al), titanium (Ti), calcium (Ca), etc. Also, heat treatment (electrode baking process) of the core member 11, given after the electrode paste has been applied to the bottom surface 11B of the lower flange part 11*c*, is implemented under the conditions of, for example, 750 to 900° C. in temperature in atmosphere or $N_2$ gas atmosphere of 10 ppm or less in oxygen concentration. By forming the terminal electrodes 16A, 16B this way, the core member 11 is firmly bonded to a conductive layer constituted by a specified electrode material.

(c) Coil Conductive Wire Winding Step S103

Next, in the coil conductive wire winding step S103, a sheathed conductive wire is wound around the core 11*a* of the core member 11 by a specified number of times. To be specific, the upper flange part 11*b* of the core member 11 is secured by a chuck of a winding apparatus in such a way that the core 11*a* of the core member 11 is exposed. Next, a sheathed conductive wire of 0.1 to 0.2 mm in diameter, for example, is tentatively attached to one of the terminal electrodes 16A, 16B formed on the bottom surface 11B of the lower flange part 11*c* (or grooves 15A, 15B), and cut in this condition to form one end of a coil conductive wire 12. Thereafter, the chuck is turned and the sheathed conductive wire is wound 3.5 to 15.5 times, for example, around the core 11*a*. Next, the sheathed conductive wire is tentatively attached to the other of the terminal electrodes 16A, 16B (or grooves 15A, 15B), and cut in this condition to form the other end of the coil conductive wire 12, thereby forming a core member 11 constituted by the coil conductive wire 12 wound around the core 11*a*. The one end and other end of the coil conductive wire 12 correspond to the ends 13A, 13B mentioned above.

(d) Outer Sheath Step S104

Next, in the outer sheath step S104, an outer sheath resin part 18 constituted by a magnetic powder-containing resin containing an inorganic filler at a specified ratio is formed in a manner covering an outer periphery of the coil conductive wire 12 wound around the core 11*a* between the upper flange part 11*b* and lower flange part 11*c* of the core member 11. To be specific, a paste of magnetic powder-containing resin containing a magnetic powder that has the same composition as the soft magnetic alloy grain constituting the core member 11 is discharged into the area between the upper flange part 11*b* and lower flange part 11*c* of the core member 11 using a dispenser, to fill the paste in a manner covering an outer periphery of the coil conductive wire 12, for example. Next, the paste of magnetic powder-containing resin is cured by heating at 150° C. for 1 hour, for example, to form an outer sheath resin part 18 covering an outer periphery of the coil conductive wire 12.

Here, the magnetic powder-containing resin discharged and filled between the upper flange part 11*b* and lower flange part 11*c* of the core member 11 is preferably such that its inorganic filler content (first content) ratio is set to at least 40 percent by volume in general, for example, while the inorganic filler content (second content) ratio in the heated and cured magnetic powder-containing resin is set to at least 50 percent by volume in general, for example. In this outer sheath step, an area 11*d* is formed where only the resin material in the magnetic powder-containing resin is permeated into the core member 11 from the surface of the core member 11 in the region contacted by the discharged and filled magnetic powder-containing resin (primarily the upper flange part 11*b* and lower flange part 11*c*; refer to FIG. 2(*a*)). In this case, the depth of the area 11*d* where the resin material is permeated is set to 10 to 30 μm in general.

Under this embodiment, the depth of the area 11*d* where the resin material is permeated is generally measured by using the following method. First, 10 photographs of the base material in the area 11*d* where the resin material had permeated were taken at 1000 to 5000 magnifications. Next, the maximum and minimum distances over which the resin material had permeated from the base material surface were measured on each captured photograph, and the distance at the midpoint was calculated. Next, the midpoint distances calculated on the 10 captured photographs were averaged and the obtained average was specified as the depth of the area 11*d* where the resin material is permeated.

(e) Coil Conductive Wire Bonding Step S105

Next, in the coil conductive wire bonding step S105, first the insulation sheath 14 is stripped and removed at both ends 13A, 13B of the coil conductive wire 12 wound around the core member 11. To be specific, a sheath stripping solvent is applied, or laser beam of a specified energy is irradiated, to both ends 13A, 13B of the coil conductive wire 12 wound around the core member 11, to melt or vaporize the resin material forming the insulation sheath 14 near both ends 13A, 13B of the coil conductive wire 12, to completely strip and remove the insulation sheath.

Next, both ends 13A, 13B of the coil conductive wire 12 from which the insulation sheath 14 has been stripped are soldered and conductively connected to the terminal electrodes 16A, 16B, respectively. To be specific, a solder paste containing flux is applied by the stencil printing method, for example, to the terminal electrodes 16A, 16B containing both ends 13A, 13B of the coil conductive wire 12 from which the insulation sheath 14 has been stripped, which is followed by pressurization under heating using a hot plate heated to 240° C. to melt and fix the solder to join both ends 13A, 13B of the coil conductive wire 12 with the terminal electrodes 16A, 16B via solders 17A, 17B, respectively. After the coil conductive wire 12 has been soldered to the terminal electrodes 16A, 16B, a cleaning process is performed to remove the flux residue.

(Verification of Operation and Effects)

Next, the operation and effects of the electronic component and method of manufacturing such electronic component conforming to the present invention are explained.

Here, the operation and effects of the electrode forming method for the electronic component conforming to the present invention are verified using a comparative electronic component whose base material is constituted by a known ferrite. The electronic component whose base material is constituted by a ferrite has been installed in wire wound inductors as mentioned above and various electronic devices already available on the market in general, where various constitutions and methods have been devised to improve the durability under changes in the use environment (temperature, humidity, etc.) and productivity, of the electronic component which is highly rated in the market.

Figure 4:
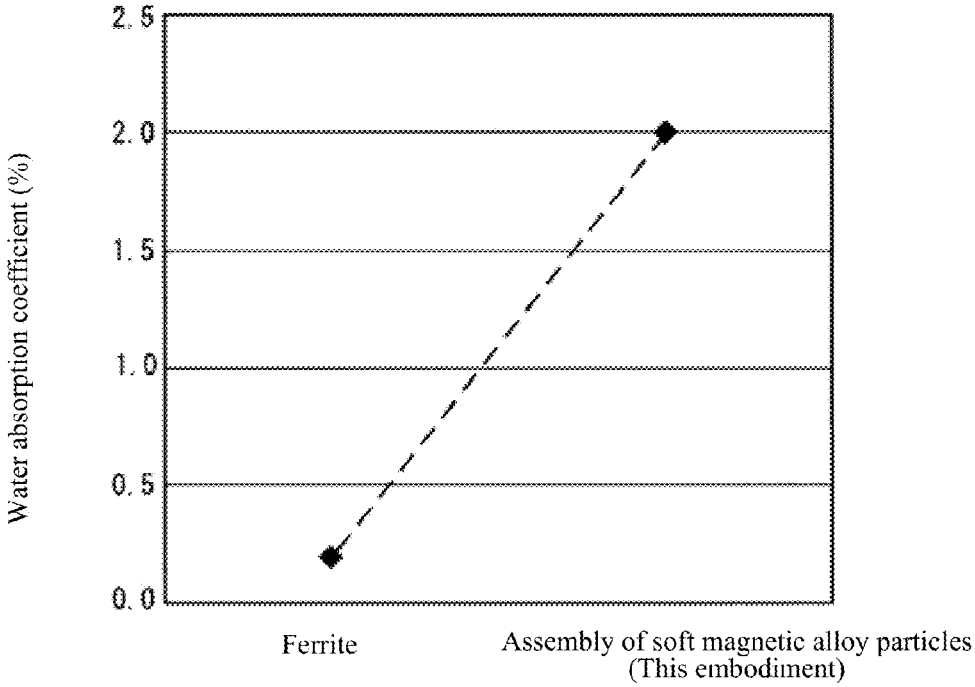
FIG. 4 shows the permeation characteristics (showing a table in (a) and a graph in (b)) of resin material in the assembly of soft magnetic alloy grains (compact) and ferrite applied for a base material of an electronic component conforming to the present invention.
Figure 5:
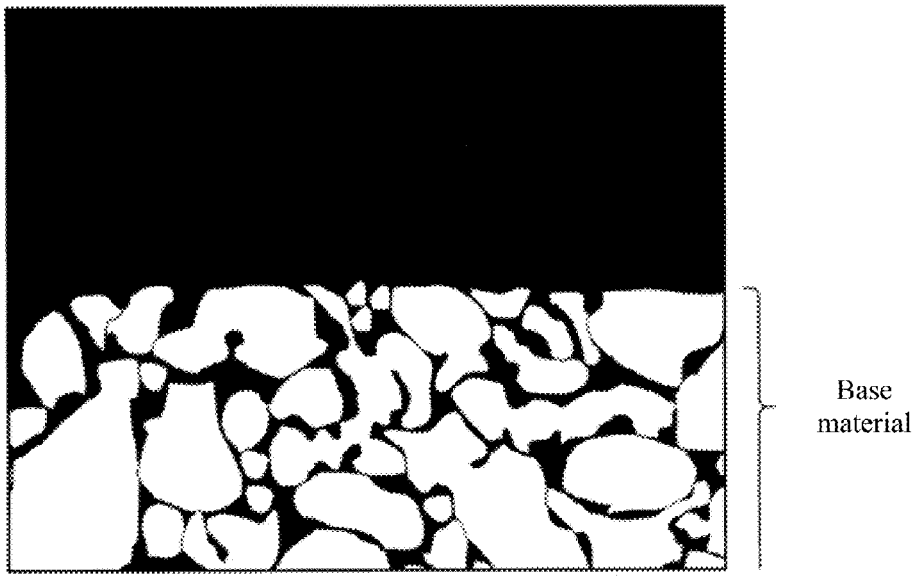
FIG. 5 illustrates schematic views showing sections near the surface of a base material conforming to the present invention in (a) and near the surface of a base material constituted by a ferrite in (b).
Figure 5:
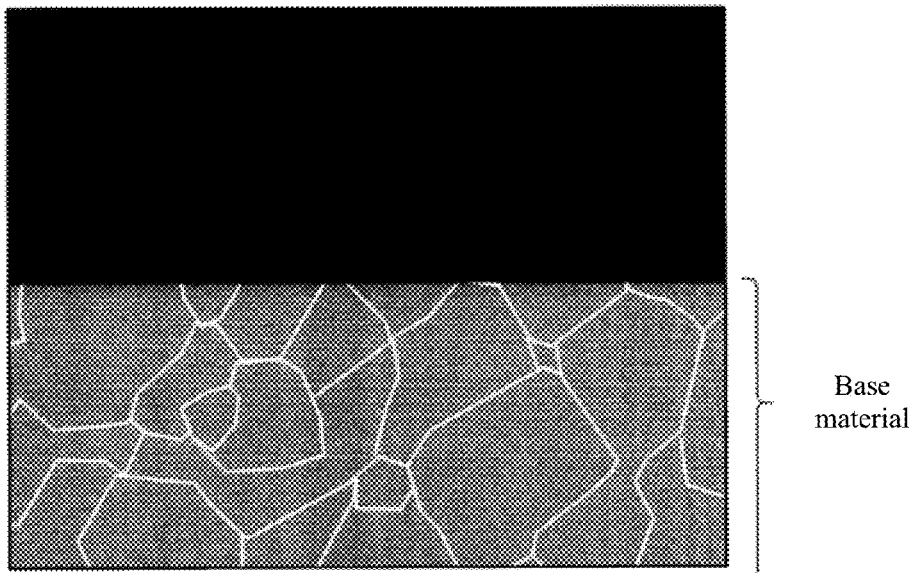
Figure 6:
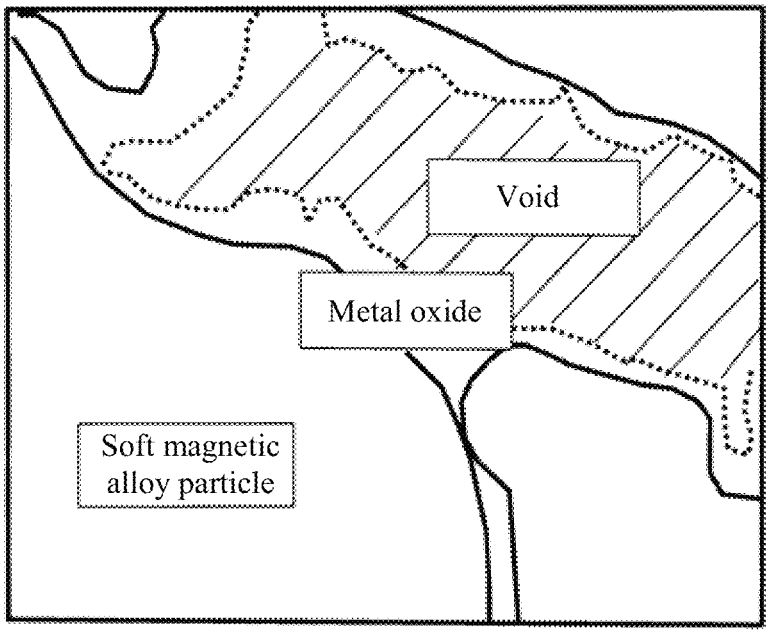
FIG. 6 illustrates enlarged schematic views explaining sections near the surface of a base material, before being impregnated with a resin material in (a) and after being impregnated with a resin material in (b), conforming to the present invention.
Figure 6:
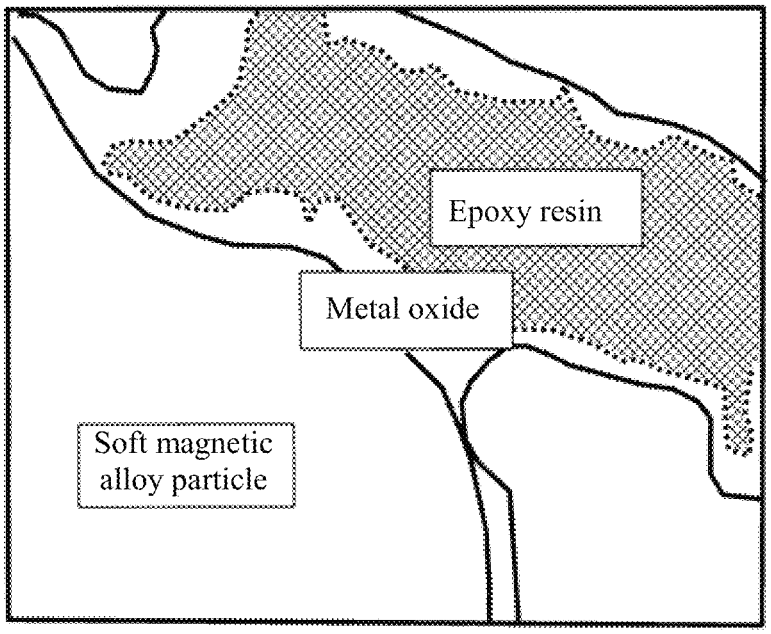

FIG. 4 provides figures showing the permeation characteristics of resin material in the assembly of soft magnetic alloy grains (compact) and ferrite applied for a base material of an electronic component conforming to the present invention. Here, (a) in FIG. 4 is a table showing the different water absorption coefficients, densities (apparent densities and true densities) and void ratios of a base material conforming to the present invention and base material constituted by a ferrite, while (b) in FIG. 4 is a graph showing the different water absorption coefficients of a base material conforming to the present invention and base material constituted by a ferrite. FIG. 5 provides schematic views showing sections near the surface of a base material conforming to the present invention and near the surface of a base material constituted by a ferrite. (a) in FIG. 5 is a schematic view showing a section near the surface of a base material conforming to the present invention, while (b) in FIG. 5 is a schematic view showing a section near the surface of a base material constituted by a ferrite. FIG. 6 provides enlarged schematic views explaining sections near the surface of a base material conforming to the present invention. (a) in FIG. 6 is an enlarged schematic view showing the condition before permeation of resin material of a base material conforming to the present invention, while (b) in FIG. 6 is an enlarged schematic view showing the condition after permeation of resin material of a base material conforming to the present invention.

As mentioned above, the assembly of soft magnetic alloy grains applied for the base material of the electronic component conforming to the present invention is porous and therefore, as shown in (a) and (b) in FIG. 4, its water absorption coefficient and void ratio are higher than any known ferrite having a dense crystal structure. To be specific, the base material conforming to the present invention exhibits a high water absorption coefficient of 2% and high void ratio of 18.4% when its base body having a true density of 7.6 g/cm$^3$ has an apparent density of 6.2 g/cm$^3$, for example. On the other hand, the base material constituted by a ferrite exhibits a low water absorption coefficient of 0.2% and low void ratio of 0.2%, both of which are generally one-tenth the corresponding values of the base material conforming to the present invention or lower, when its base body having a true density of 5.35 g/cm$^3$ has an apparent density of 5.34 g/cm$^3$, for example. This condition is shown in FIG. 5.

In other words, as shown in (a) in each of FIGS. 5 and 6, the base material conforming to the present invention has oxidized films formed on the surfaces of soft magnetic alloy grains and is structured in such a way that soft magnetic alloy grains are bonded together via the oxidized films, and therefore relatively large voids are present in a roughly uniform manner between soft magnetic alloy grains at the surface of and inside the base material. On the other hand, as shown in (b) in FIG. 5, the base material constituted by a known ferrite has a dense crystal structure and there are virtually no voids inside the base material.

Under the embodiment explained above, a magnetic powder-containing resin whose magnetic powder content has been set to a first content ratio is applied to such porous base material and cured to cause only the resin material (such as epoxy resin) in the magnetic powder-containing resin to permeate into the voids between soft magnetic alloy grains inside the base material, thereby forming an outer sheath resin part 18 constituted by a magnetic powder-containing resin whose magnetic powder content is set to a second content ratio which is relatively higher than the first content ratio.

Next, the relationship of inorganic filler content and linear expansion coefficient when a magnetic powder-containing resin is applied to the aforementioned porous base material is verified.

Figure 7:
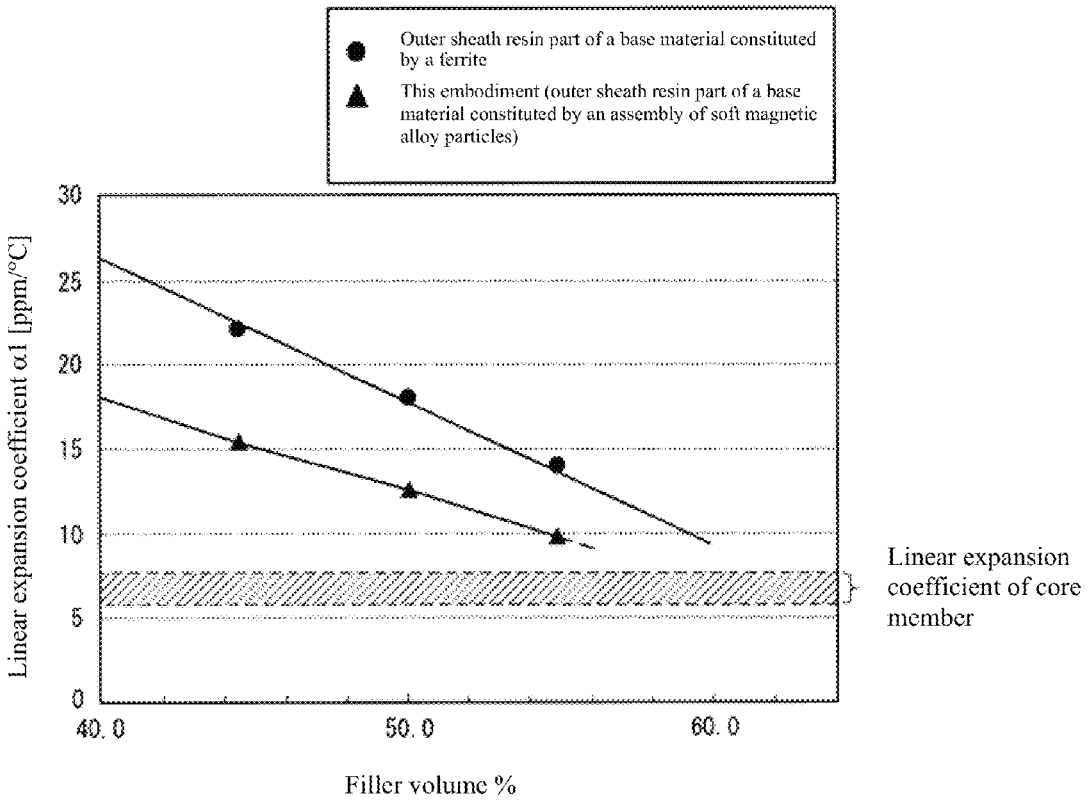
FIG. 7 is a graph showing the relationship of inorganic filler content and linear expansion coefficient when a magnetic powder-containing resin is applied to a base material conforming to the present invention and base material constituted by a ferrite.

FIG. 7 is a graph showing the relationship of inorganic filler content and linear expansion coefficient when a magnetic powder-containing resin is applied to a base material conforming to the present invention and base material constituted by a ferrite.

When a magnetic powder-containing resin is applied to the aforementioned porous base material and cured, the linear expansion coefficient tends to drop as the inorganic filler content in the magnetic powder-containing resin increases, as shown in FIG. 7. Also when a magnetic powder-containing resin is applied to a base material constituted by a ferrite and cured, the linear expansion coefficient is approx. 50% higher than the aforementioned porous base material, for example, and tends to drop as the inorganic filler content in the magnetic powder-containing resin increases, as shown in FIG. 7. The above confirms that, with the porous base material where the resin material in the applied magnetic powder-containing resin permeates easily into the base material, the magnetic powder content after the magnetic powder-containing resin has been cured tends to be higher by approx. 5 to 10 percent by volume.

This means that, with the wire wound inductor presented in the aforementioned embodiment, at least the ratio (content) of the magnetic powder in the magnetic powder-containing resin can be relatively raised near the interface where the outer sheath resin part 18 contacts the core member 11, thereby reducing the linear expansion coefficient of the magnetic powder-containing resin to make its difference from the linear expansion coefficient of the core member 11 (especially the upper flange part 11*b* and lower flange part 11*c*) smaller, consequently improving the resistance of the wire wound inductor 10 against changes in the use environment (especially temperature change). This enhances the reliability of the electronic component.

Presenting the specific values for the wire wound inductor presented in the aforementioned embodiment, a metal powder of 6 to 23 μm in grain size (such as 4.5Cr3SiFe by Atomix), for example, is formed (such as at 6.0 to 6.6 $g/cm^3$→theoretical void ratio of 22 to 13%), ground, and baked to manufacture a drum-shaped core member 11. Next, terminal electrodes 16A, 16B are formed in the lower flange part 11*c* of the core member 11, after which a coil conductive wire 12 constituted by a sheathed conductive wire is wound around the core 11*a*. Next, a magnetic powder-containing resin (such as one containing an inorganic filler by 55 percent by volume) is applied to the wound coil conductive wire 12 and cured, after which the terminal electrodes 16A, 16B and coil conductive wire 12 are soldered to manufacture a wire wound inductor 10.

Here, because only the resin material in the magnetic powder-containing resin permeates into the core member 11 in the step to apply and cure the magnetic powder-containing resin, as mentioned above, the linear expansion coefficient of the magnetic powder-containing resin containing an inorganic filler by 55 percent by volume is approx. 10 ppm/° C. and lower than approx. 14 ppm/° C. achieved when the magnetic powder-containing resin is applied and cured on a base material constituted by a ferrite into which very little resin material permeates, and consequently the difference from the linear expansion coefficient of the core member 11 can be reduced. Accordingly, as indicated in the aforementioned verification of operation and effects, the electronic component or electronic device in which the electronic component is installed demonstrates improved resistance against changes in the use environment as well as higher reliability (heat cycle resistance). Also, by maintaining discharge fluidity when applying the magnetic powder-containing resin to the core member 11, while allowing the resin material to permeate into the core member 11 by an appropriate degree after the application, fluidity and wettability of the magnetic powder-containing resin can be controlled, and productivity improved. If the linear expansion coefficient (10 ppm/° C.) applicable here is applied to a base material constituted by a ferrite, the inorganic filler content becomes approx. 59 percent by volume, as shown in FIG. 7, suggesting a significant drop in discharge property and fluidity of the magnetic powder-containing resin to the extent that the resin cannot be applied in a favorable manner.

Also, the relationship of inorganic filler content and linear expansion coefficient mentioned above under this embodiment can be rephrased as follows. That is to say, terminal electrodes 16A, 16B are formed on a core member 11 having the same composition and structure described above, and then a coil conductive wire 12 is wound around its core 11*a*. Next, a magnetic powder-containing resin (such as one containing an inorganic filler by 44 percent by volume) is applied to an outer periphery of the wound coil conductive wire 12 and cured, after which the terminal electrodes 16A, 16B and coil conductive wire 12 are soldered to manufacture a wire wound inductor 10.

Here, because only the resin material in the magnetic powder-containing resin permeates into the core member 11 in the step to apply and cure the magnetic powder-containing resin containing an inorganic filler by 44 percent by volume, as mentioned above, the linear expansion coefficient becomes approx. 15 ppm/° C., for example, as shown in FIG. 7. This value corresponds to the linear expansion coefficient achieved when a magnetic powder-containing resin containing an inorganic filler by approx. 53 percent by volume is applied and cured on a base material constituted by a ferrite into which very little resin material permeates, indicating that the difference from the linear expansion coefficient of the core member 11 can be made relatively small even when the inorganic filler content is lower than when a ferrite is used. Also when 5 percent by volume, for example, of the resin material in the magnetic powder-containing resin is assumed to permeate into the core member 11, the inorganic filler content can be set lower when the magnetic powder-containing resin is applied. Accordingly, as indicated in the aforementioned verification of operation and effects, while maintaining the resistance of the electronic component against changes in the use environment (especially temperature change) at a certain level, the discharge property and fluidity of the magnetic powder-containing resin to be applied can be improved in the outer sheath step to improve productivity. If this inorganic filler content (44 percent by volume) is applied to a base material constituted by a ferrite, the linear expansion coefficient becomes as high as approx. 22 ppm/° C., as shown in FIG. 7, and the difference from the linear expansion coefficient of the core member 11 becomes extremely large, and the electronic component can no longer provide sufficient resistance against changes in the use environment at this level of linear expansion coefficient.

Although the aforementioned embodiment explained a case where an inductor is applied as an electronic component conforming to the present invention, the present invention is not at all limited to the foregoing. In other words, the electronic component and method of manufacturing such electronic component conforming to the present invention can be favorably applied to any other electronic component as long as the electronic component has a porous base material and is sheathed and protected by applying and curing a resin material (magnetic powder-containing resin) containing an inorganic filler.

INDUSTRIAL FIELD OF APPLICATION

The present invention is suitable for a small inductor that can be surface-mounted on a circuit board or other electronic component having an outer sheath structure. In particular, the present invention is extremely effective in an electronic component having a porous base material as it can enhance the resistance of the component against the use environment.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. In this disclosure, any defined meanings do not necessarily exclude ordinary and customary meanings in some embodiments. Also, in this disclosure, "the invention" or "the present invention" refers to one or more of the embodiments or aspects explicitly, necessarily, or inherently disclosed herein.

The present application claims priority to Japanese Patent Application No. 2011-183443, filed Aug. 25, 2011, the disclosure of which is incorporated herein by reference in its entirety. In some embodiments, as the base material and structures thereof, those disclosed in U.S. Patent Application Publication No. 2011/0267167 and No. 2012/0038449, co-assigned U.S. patent application Ser. Nos. 13/313,982, 13/313,999, 13/351,078 can be used, each disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. An electronic component characterized by comprising:

a base material constituted by an assembly of soft magnetic alloy grains;

a sheathed conductive wire wound around the base material; and an outer sheath resin part constituted by a resin material containing a filler and which covers an outer periphery of the sheathed conductive wire;

wherein the resin material is permeated into the base material from an interface of the base material in contact with the outer sheath resin part, said resin material being permeated into the base material from the interface to a depth of 10 to 30 μm.

2. An electronic component according to claim 1, characterized in that the resin material constituting the outer sheath resin part contains the filler by 50 percent by volume or more.

3. An electronic component according to claim 1, characterized in that the base material has a water absorption coefficient of 1.0% or more and a void ratio of 10 to 25%.

4. An electronic component according to claim 1, characterized in that the base material is constituted by the soft magnetic alloy grains containing iron, silicate and an element that oxidizes more easily than iron, each soft magnetic alloy grain has an oxidized layer formed on its surface as a result of oxidization of the soft magnetic alloy grain, the oxidized layer contains the element that oxidizes more easily than iron by an amount greater than does the soft magnetic alloy grain, and the grains are bonded together via the oxidized layer.

5. An electronic component according to claim 4, characterized in that the element that oxidizes more easily than iron is chromium and the soft magnetic alloy contains chromium by at least 2 to 15 percent by weight.

6. An electronic component according to claim 1, characterized by comprising:

the base material having a pillar-shaped core and a pair of flange parts provided on both sides of the core;

the sheathed conductive wire wound around the core of the base material;

a pair of terminal electrodes provided on outer surfaces of the flange parts and connected to both ends of the sheathed conductive wire; and the outer sheath resin part provided between the pair of flange parts in a manner covering an outer periphery of the sheathed conductive wire;

wherein the resin material is permeated at least through surfaces contacted by the outer sheath resin part and facing the pair of flange parts.

* * * * *